United States Patent [19]

Griffin

[11] Patent Number: 4,813,329

[45] Date of Patent: Mar. 21, 1989

[54] MUSICAL WALL HANGING

[76] Inventor: Jim Griffin, 1236 S. Oak Grove, Springfield, Mo. 65804

[21] Appl. No.: 141,485

[22] Filed: Jan. 7, 1988

[51] Int. Cl.[4] ..... G10F 1/06

[52] U.S. Cl. ..... 84/94.2

[58] Field of Search ..... 84/94.1, 94.2, 95.1, 84/95.2; 369/31

[56] References Cited

U.S. PATENT DOCUMENTS 4,525,821 6/1985 Garcia ..... 369/31

4,653,377 3/1987 Chen ..... 84/94.2

*Primary Examiner*—L. T. Hix

*Assistant Examiner*—Brian W. Brown

[57] ABSTRACT

A musical wall hanging, in the shape of a decorative figurine, has no forwardly visible music box or mechanism for actuating a music box retained therein. The wall hanging includes a body member with an upper wall attachment device and a lower opening in which is mounted a music box. An actuator mechanism extends outwardly from a back surface of the body member so that when the body member is forced towards the wall the music box is activated.

6 Claims, 2 Drawing Sheets

MUSICAL WALL HANGING

BACKGROUND OF THE INVENTION

1. Field of the Invention

The present invention relates to a musical wall hanging and, more particularly, to such a wall hanging that has no forwardly visible mechanism for generation of music or actuation thereof.

2. Setting of the Invention

Music boxes have been made for centuries wherein a spring driven chime is concealed within animal figures, jewelry boxes and the like. These devices all required some mechanism to rewind the spring drive, again which were usually concealed.

With the advent of miniature electronics, new electronic (battery powered) music boxes became available. Soon such new electronic music boxes were placed within the usual figures and jewelry boxes, as well as in books and greeting cards.

The spring driven music boxes were usually not placed within wall hangings, i.e. figures, pictures, frames and the like, because of their weight, thickness and the necessity to hold or remove the wall hanging to rewind the spring drive.

An unusual wall hanging would be one where it contained an electronic music box so that it was self contained and extremely well hidden so the method of actuation would be difficult to determine.

SUMMARY OF THE INVENTION

The present invention has been contemplated to provide the unique music box described above. The musical wall hanging of the present invention has no forwardly visible mechanism for generation of music or actuation thereof. A body member forming the wall hanging includes a mechanism to retain it against a vertical planar surface, such as a wall. A lower portion of the body member includes an opening extending from a back surface partially therethrough. A music box is mounted within the opening and an actuator mechanism extends outwardly therefrom to bear against and space the lower portion of the body member from the vertical planar surface. When the lower portion of the body member is forced towards the vertical planar surface the music box is actuated.

DETAILED DESCRIPTION OF THE PREFERRED EMBODIMENTS

Figure 1:
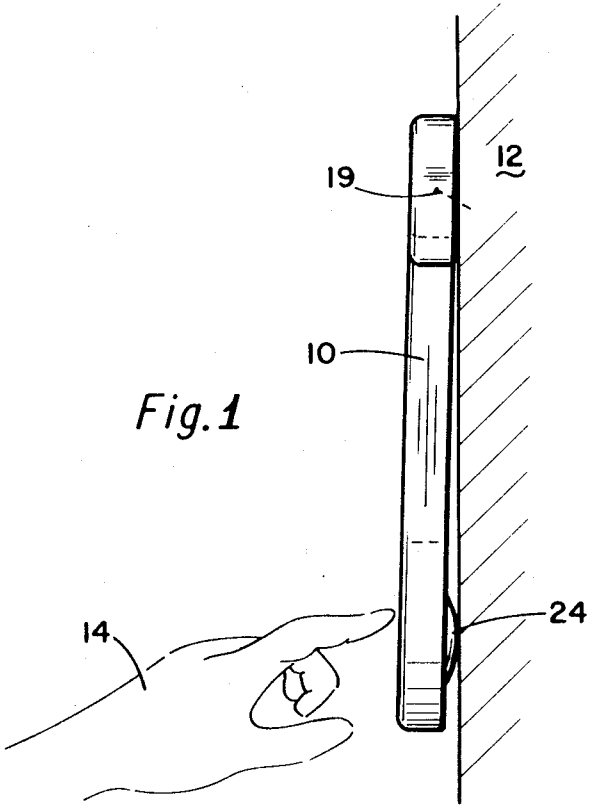
FIG. 1 is a side elevational view of a musican wall hanging, embodying the present invention.

The present invention provides a musical wall hanging that has no forwardly visible mechanism for generation or actuation thereof. As shown in FIG. 1, a musical wall hanging 10 is retained against a vertical planar surface, such as a wall 12, and is being actuated by pressure/movement from a person's hand 14.

Figure 3:
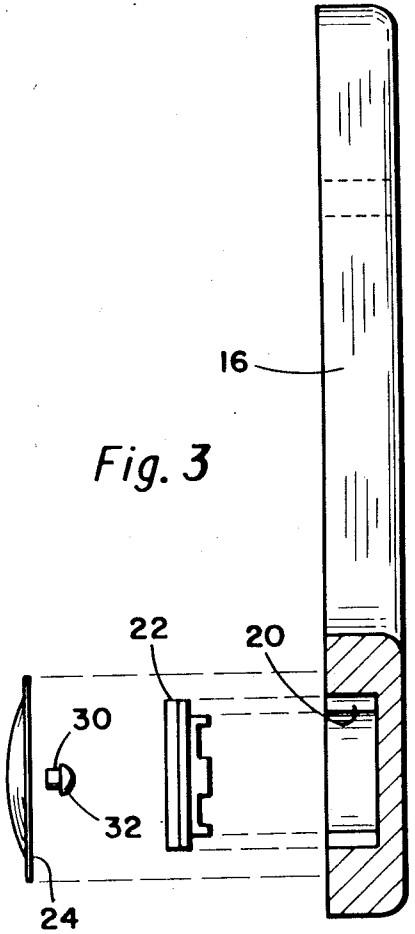
FIG. 3 is a side elevational view with partial cutaway of one embodiment of the present invention.
Figure 2:
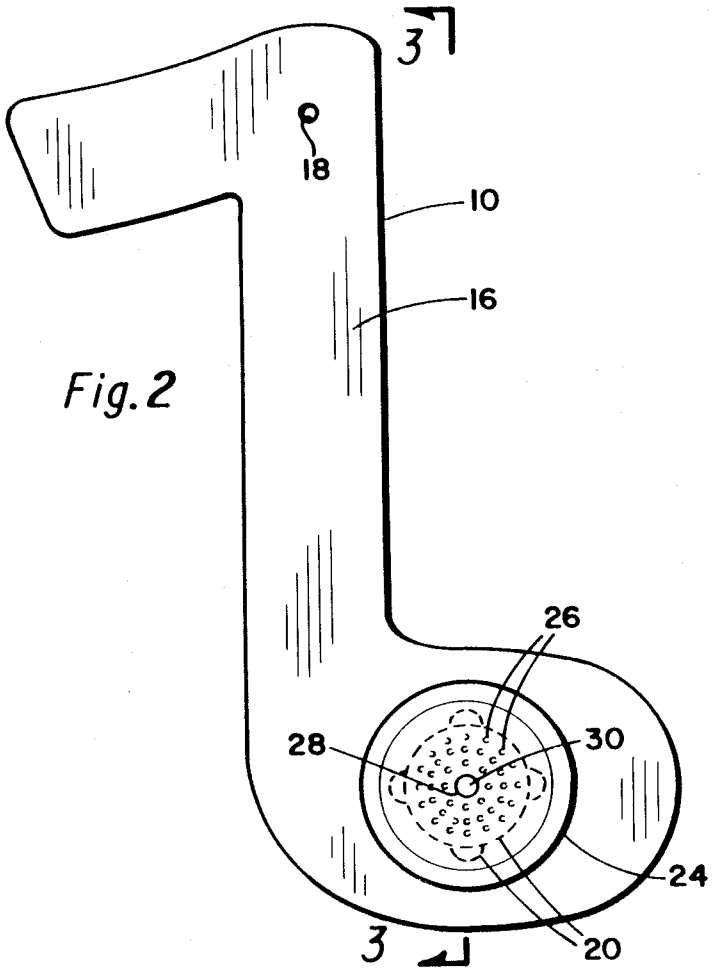
FIG. 2 is an elevational view of a back surface of one embodiment of the present invention.

As shown in more detail in FIGS. 2 and 3, the musical wall hanging 10 generally is formed from a body member 16 which can be in any desired shape, construction or formed from any desired material. The body member 16 is shown only for example as a one piece musical note formed from wood. However, the body member 16 can be a letter, number, symbol, two or three dimensional shape, figurine, such as an animal or child, or the like. The body member 16 can be integral within another object, such as a clock. Further, the body member 16 can be formed from more than one piece of wood, metal, plastic, fabric or ceramic material.

Provided within an upper portion of the body member 16 is a mechanism to retain or hold up the wall hanging against the wall 12. This mechanism can be a bracket attached to a side or back surface of the body member 16, an eye bolt mounted to an upper surface of the body member 16 or a hole 18 into which a nail 19 can extend into from the wall 12 (FIG. 1).

Provided within a lower portion of the body member 16 is an opening 20 which extends fom a back surface of the body member 16 partially therethrough. Into the opening 20 is retained an electronic music box 22. Usually the depth of the opening 20 is at least as great as the width of the music box 22 so that it is flush mounted within the body member 16. The music box 22 can be of any suitable shape, size or operational type. Generally, the music box 22 is an electronic, self-contained (battery-powered) music box that has a button or depressable activation plate on a front or rear surface to actuate the generation of music. Further, a spring-driven music box can be used as desired.

A cover 24, formed from plastic, metal or fabric, is removably attached to the back surface of the body member 16 across the music box 22 and the opening 20 by way of nails, tacks, screws or brads, as desired. The cover 24 can include a plurality of spaced holes 26 to facilitate the passage of music from the music box 16. The cover 24 includes a central bore 28 through which extends a button or actuator 30. The actuator 30 includes an enlarged portion 32 to prevent the actuator 30 from passing totally through the bore 28. Further, the actuator 30 extends a partial distance outwardly from the cover 24.

Figure 4:
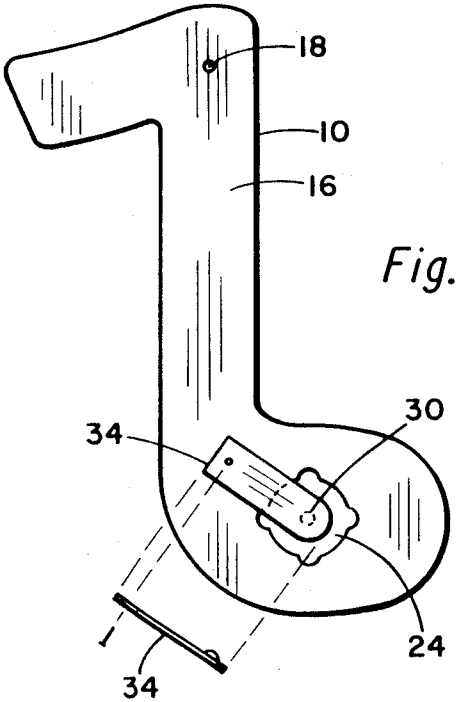
FIG. 4 is an elevational view of a back surface of an alternate embodiment of the present invention.

An alternate embodiment of the present invention is shown in FIG. 4 wherein the cover 24 does or does not include a central bore 28 and includes a button 40 which either does not extend through the cover 24 or does, depending upon the presence of the bore 28. An arm member 34 has an upper portion mounted to a back surface of the body member 16 by way of a nail, screw, tack or brad. The arm member 34 extends across the cover 24 and across the location of the button 30.

In the use of the present invention, the body member 16 is formed as desired with the openings 18 and 20, as desired. The music box 22 having the tune desired is placed within the opening 20 with the actuator plate facing outwardly. The button or actuator 30 is pushed through the bore 28 in the cover 24 and the cover 24 is then mounted to the body member 16 across the opening 20. A nail 19 is driven into the wall 12 and the body member 16 is hung on the nail 19 via the bore 18 and the actuator 30 or the arm member 34 bears against the wall 12. Since the music box 22, its cover 24 and actuating mechanism is hidden from view, a person will not know that either the body member 16 is indeed a musical wall hanging or how to "turn on" the music. Only by a person's hand 14 pressing the body member 16 against the wall 12 will music start.

Wherein the present invention has been described in particular relation to the drawings attached hereto, it should be understood that other and further modifications, apart from those shown or suggested herein, can be made to the present invention.

What is claimed is:

1. A musical wall hanging having no forwardly visible means for generation of music or actuation thereof, comprising:

a body member having an upper portion and a lower portion, the upper portion including means to retain the body member against a vertical planar surface;

the lower portion includes an opening extending from a back surface partially therethrough;

a music box mounted within the opening; and actuator means extending outwardly from the music box to bear against and space the lower portion of the body member from the vertical planar surface, wherein when the lower portion of the body member is forced towards the vertical planar surface the music box is activated.

2. A musical wall hanging of claim 1 wherein the body member is a one piece elongated figurine.

3. A musical wall hanging of claim 1 wherein the means to retain comprises a bore extending into the body member from the back surface thereof.

4. A musical wall hanging of claim 1 wherein the music box comprises an electronic, self-contained music box, and including an activation plate on an outwardly facing surface thereof that cooperates with the actuator means.

5. A musical wall hanging of claim 1 including a removable cover plate attached to the back surface of the body member with a bore through which extends the actuator means and a plurality of spaced holes therein.

6. A musical wall hanging of claim 1 including a removable arm member attached at one end thereof to the back surface of the body member and extending across the music box to retain the music box within the opening.

* * * * *